US005111764A

United States Patent [19]

D'Ettorre

[11] Patent Number: 5,111,764

[45] Date of Patent: May 12, 1992

[54] METHOD AND APPARATUS FOR RECOVERING THE SUBSTRUCTURE OF AN OFFSHORE PLATFORM

[75] Inventor: Jean-Marie D'Ettorre, Montigny-sur-Loing, France

[73] Assignee: Bouygues Offshore, Montigny-Le-Bretonneux, France

[21] Appl. No.: 647,503

[22] Filed: Jan. 29, 1991

[30] Foreign Application Priority Data

Jan. 31, 1990 [FR] France ..... 90 01127

[51] Int. Cl.[5] ..... B63B 35/40

[52] U.S. Cl. ..... 114/259; 405/219

[58] Field of Search ..... 114/44, 45, 26, 46, 114/47, 48, 49, 53, 264, 259; 405/3, 209, 219–221

[56] References Cited

U.S. PATENT DOCUMENTS

| | | | |
|---|---|---|---|
| 2,946,566 | 7/1960 | Samuelson | 114/53 |
| 3,823,564 | 7/1974 | Crout et al. | 114/259 |
| 3,859,804 | 1/1975 | Koehler et al. | 114/259 |

*Primary Examiner*—Jesus D. Sotelo

*Attorney, Agent, or Firm*—Blakely, Sokoloff, Taylor & Zafman

[57] ABSTRACT

This invention relates to recovering the substructure of an offshore platform. A floating barge is used comprising a ballastable hull having a deck suitable for receiving the substructure in a substantially horizontal position and including ballastable floats disposed above the deck to right and to left of the intended location for the substructure. The hull and the floats are ballasted so that although it does not sink, the barge moves down into the water and tilts into a position where its deck can be moved against one of the faces of the substructure. The barge is fixed to the substructure, the substructure is disconnected from the sea bed, ballast is removed from the barge to return it to a position where it is floating and carrying the substructure, and the barge is moved to the desired location for unloading the substructure. The invention is applicable to recovering substructures of large dimensions.

9 Claims, 5 Drawing Sheets

METHOD AND APPARATUS FOR RECOVERING THE SUBSTRUCTURE OF AN OFFSHORE PLATFORM

The invention relates to a method and to apparatus for recovering the substructure of an offshore platform.

BACKGROUND OF THE INVENTION

It is estimated that more than 6,000 platforms have been installed worldwide.

International regulations are now tending to require them to be dismantled at the end of their period of use.

Although on-site dismantling may be considered for small substructures, it is not applicable in practice to substructures such as the large jackets in the North Sea, which may have a bottom section of 100 meters (m) by 80 m, a height of 120 m to 170 m, and a mass of about 30,000 tons.

Publication U.S. Pat. No. 3,347,052 describes a technique for for recovering an offshore substructure which consists in fixing permanently or temporarily a certain number of floats to the legs of the structure at a judicious selection of locations and in selectively ballasting the floats to change the position of the structure from its in-service vertical position to a horizontal position where the structure is floating and is capable of being towed.

Installing floats at accurate locations and the synchronization required for their ballasting constitute operations that are difficult, and it is also difficult to perform the essential monitoring of the positions and the movements of the floating structure.

It is also known that a substructure may be built on a barge that can be ballasted, the barge being used to convey the substructure to the location where it is to be installed, and being suitable by selective ballasting for tilting so as to move the structure from its horizontal transport position to its vertical in-service position (Publication U.S. Pat. Nos. 3,823,564 and 3,987,637), however this technique also requires the substructure itself to be selectively ballasted and it is not suitable for recovering a substructure.

An object of the present invention is to enable a substructure which is generally in the form of a truncated pyramid to be recovered by means of a ballastable barge without requiring the substructure itself to be ballasted and unballasted.

SUMMARY OF THE INVENTION

According to the present invention, this is achieved by performing the following operations:

bringing a floating barge close to the substructure, the barge including a ballastable hull forming a deck suitable for receiving the substructure in a substantially horizontal position and including ballastable floats above said deck to left and to right of the intended location for the substructure;

ballasting the hull and the floats so that although still floating the barge moves down in the water and tilts by pivoting through an angle of more than 90° to take up a position in which the deck of the barge is tilted beyond the vertical and may be applied against a face of the substructure;

fixing the barge to the substructure;

disconnecting the substructure from the sea bed;

removing ballast from the hull and the floats to cause the barge to tilt in the opposite direction and to raise it to a position in which the barge is floating with the substructure resting on the deck of the barge; and displacing the floating barge crying the substructure to the desired location for unloading the substructure.

In preferred implementations, the barge preferably includes one or more of the following features:

the deck of the barge is provided with longitudinal reception beams for receiving the substructure;

the deck of the barge is a concrete deck including a grid of metal beams onto which the reception beams are fixed; and in order to recover a substructure having a face which includes reinforced frame members, the reception beams are distributed in such a manner as to be applied against said frame members when the deck is applied against said face of the substructure.

BRIEF DESCRIPTION OF THE DRAWINGS

An embodiment of the invention is described by way of example with reference to the accompanying drawings, in which.

DETAILED DESCRIPTION

Figure 1:
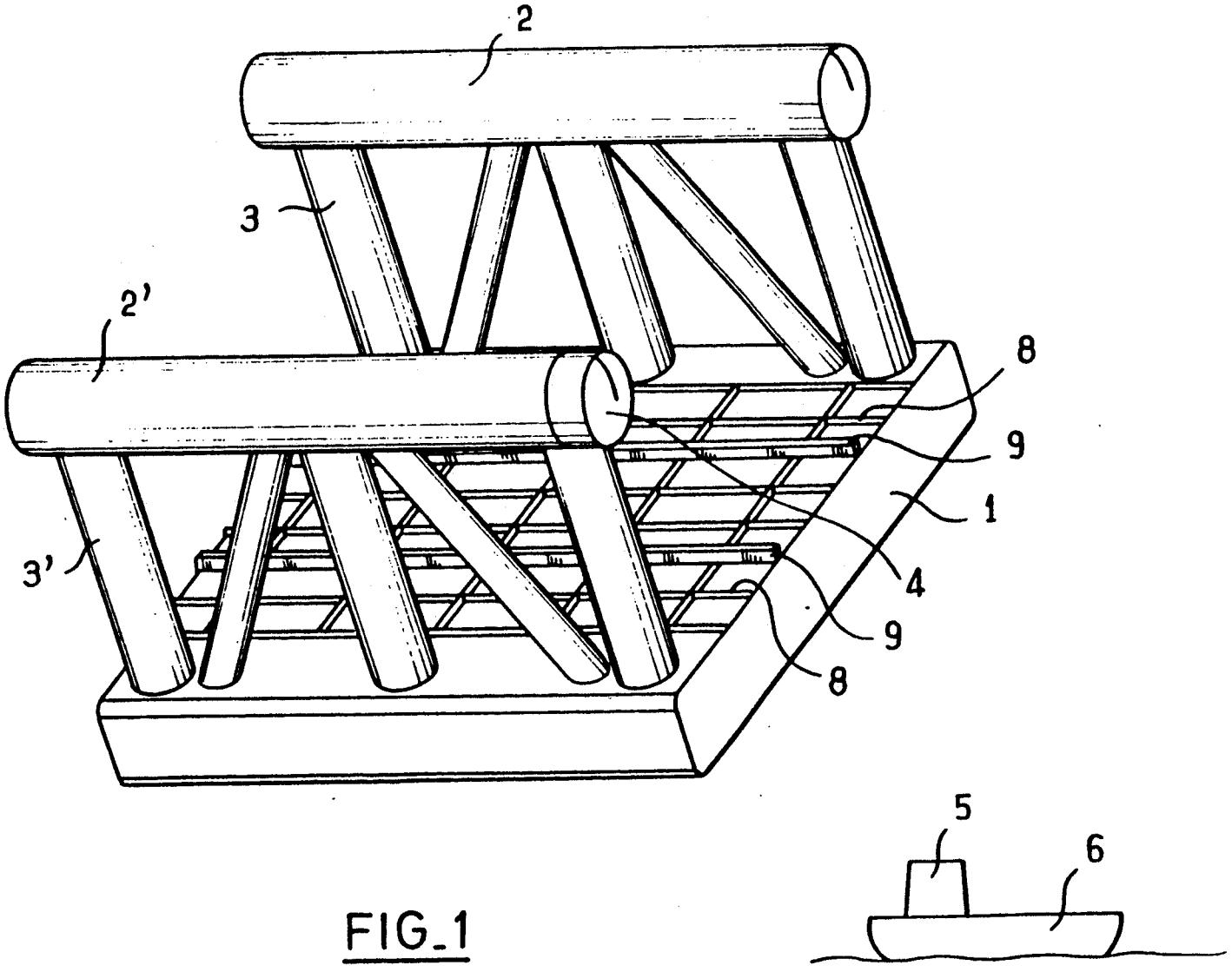
FIG. 1 shows the barge in its horizontal position.

The general appearance of the barge as shown diagrammatically in FIG. 1 is reminescent of a floating dock and it operates on the same principles during the transport stage and during the stage of transfer onto a quay.

The barge (B) is preferably made of prestressed concrete and comprises a ballastable deck 1 surmounted by two side structures which are likewise ballastable and which include longitudinally disposed cylindrical floats 2 and 2' which are preferably made of metal and which are supported by metal columns 3 and 3'.

Ballasting is performed by any suitable remote control means. In FIG. 1, reference 4 designates a remote control receiver and reference 5 designates a remote control transmitter on an auxiliary vessel 6. The barge may be self-propelled or may be displaced by means of a tug.

The barge is displaced in its generally horizontal floating position to the vicinity of a substructure (S).

Figure 2:
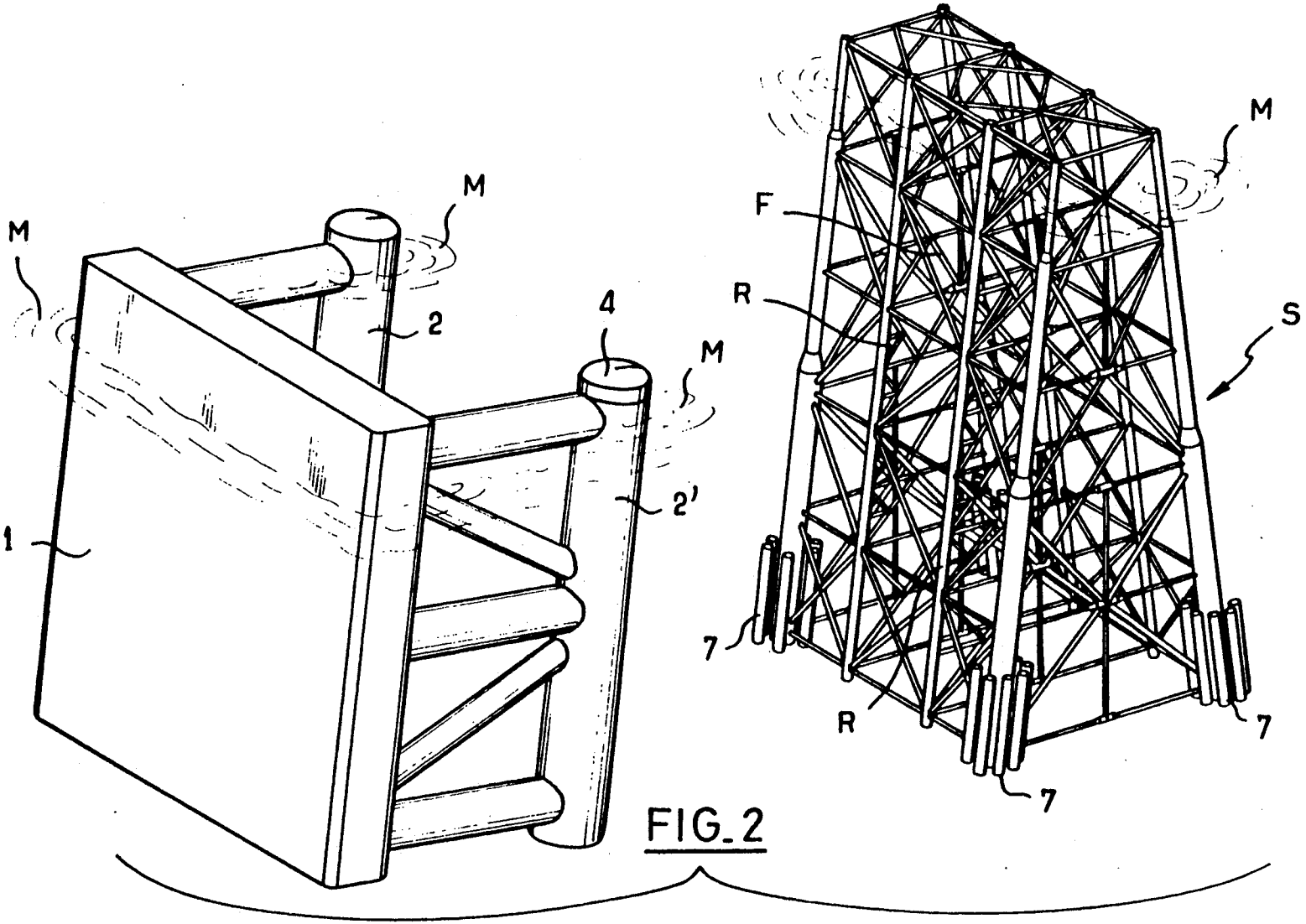
FIG. 2 shows both the reinforced face of the substructure and the barge after the barge has been tilted up.

In the example shown in FIG. 2, the substructure is constituted by a latticework of tubes that is generally in the form of a truncated pyramid whose top (that once carried a platform, which has been dismantled) projects above sea level M and whose base used to be fixed anchored in the sea bed. In order to disconnect the substructure from the sea bed, the pillars have been cut at a suitable location, e.g. at 7.

This cutting operation is performed at the moment which appears to be most desirable, under the prevailing circumstances, either before or after the barge has been connected to the substructure, with cutting being performed by any appropriate means, e.g. explosives, cutting torches, or mechanical cutting. It is preferable to cut most of the pillars before the barge is brought close and connected to the substructure, with cutting being terminated after the barge has been fixed to the substructure.

The substructure normally has a so-called "reinforced" face F which generally includes longitudinal frame member R reinforced by a strong latticework of beams inside the substructure. During construction, the substructure was built horizontally on two launching beams which were vertically beneath the reinforced frame members.

Figure 3:
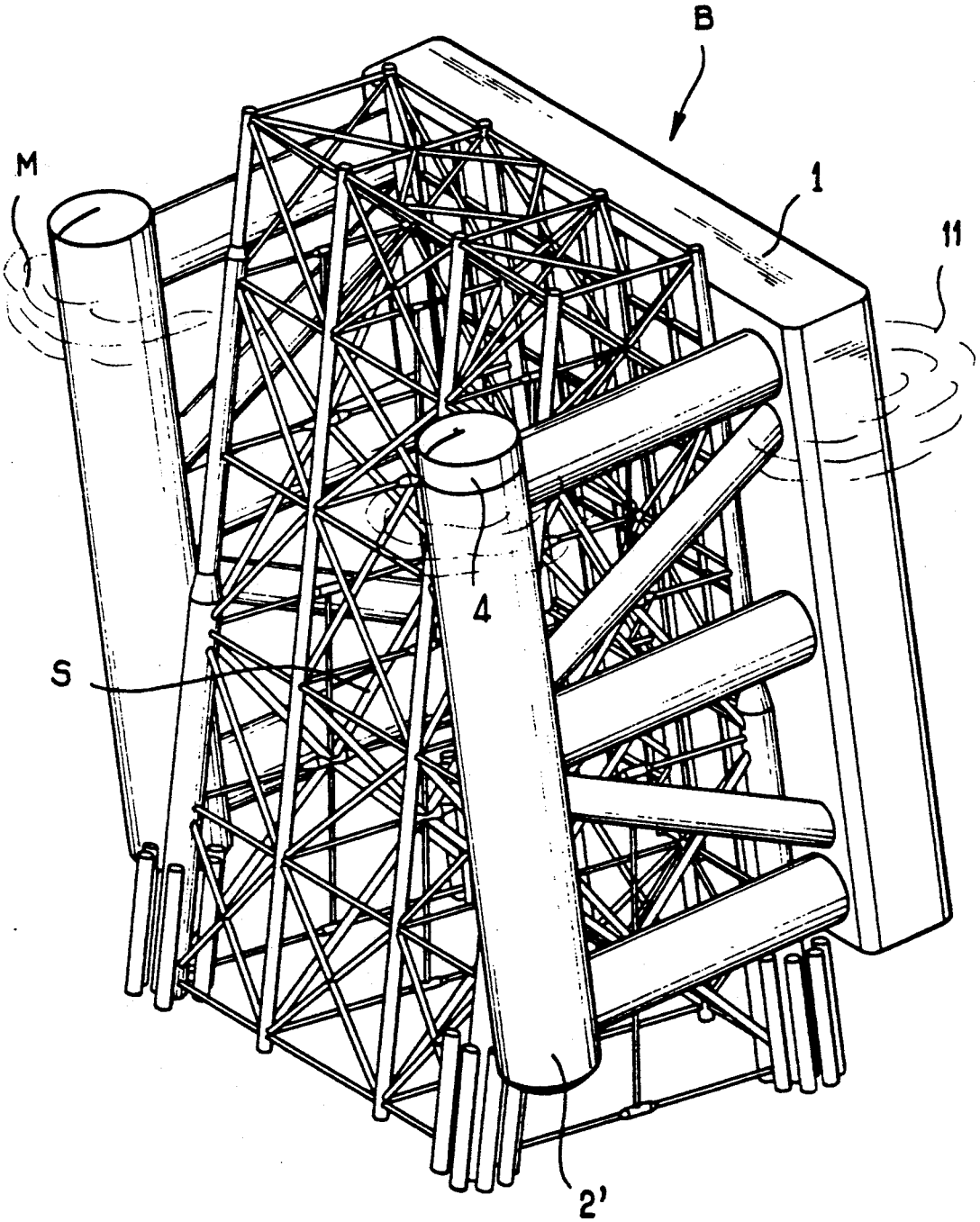
FIG. 3 shows the barge attached to the reinforced face of the substructure.

The barge is ballasted in order to cause it to move down into the water and take up angle of about 95° to about 110° so that the deck of the barge can be applied against the reinforced face of the substructure, and the barge and the substructure are fixed together by any appropriate means (FIGS. 2 and 3), e.g. by hooks or clamps driven by actuators.

The top deck 1 of the barge is preferably provided with a grid of beams 8 having a distribution of reception beams (9) welded thereto at desired locations so that the reinforced frame members of the substructure bear against the reception beams on the deck of the barge.

To clarify the drawings, the reception beams are shown only in FIG. 1.

Figure 4:
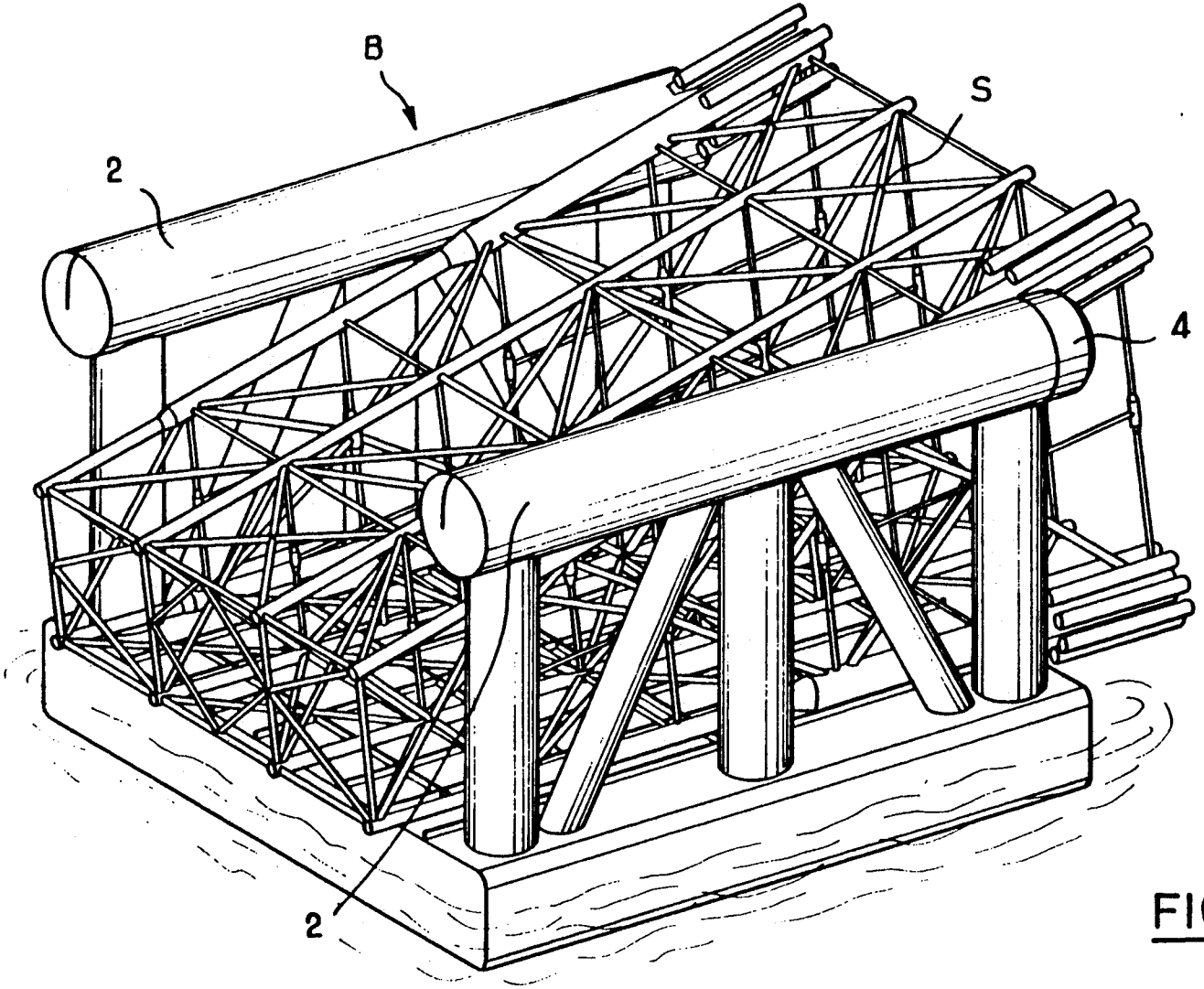
FIG. 4 shows the barge carrying the substructure after the barge has been tilted back to its transport position.
Figure 5:
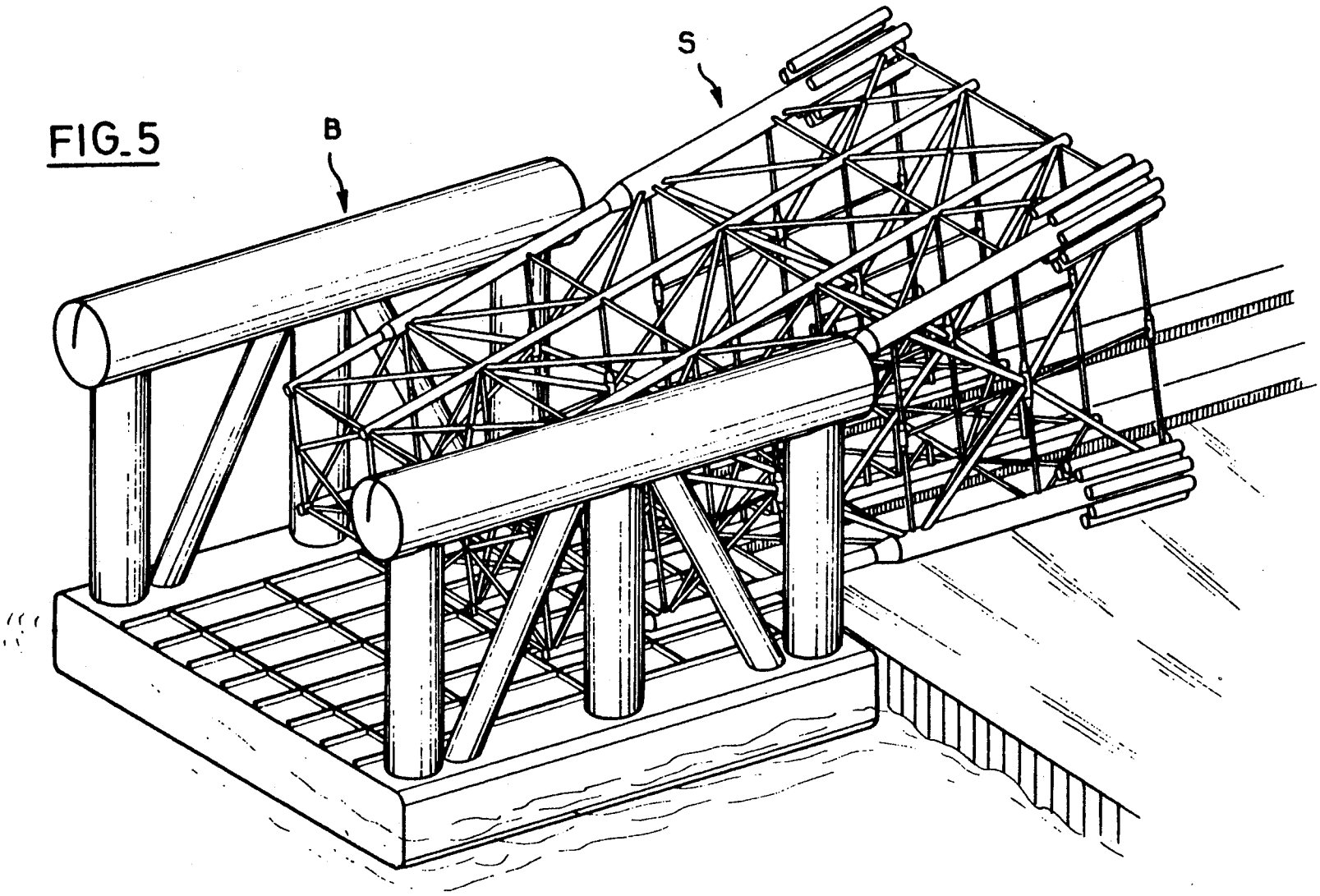
FIG. 5 shows the barge at the quayside with the substructure being unloaded therefrom.

Ballast is then removed from the barge (B) to return it to the horizontal position together with the substructure which it now carries (FIG. 4), and the barge is moved to the desired location for unloading the substructure (S) therefrom (FIG. 5).

The invention is not limited to a particular structure of ballasting means.

I claim:

1. A method of recovering a substructure of an offsea platform, with the general shape of the substructure being substantially that of a truncated pyramid, the method comprising the following operations:

bringing a floating barge close to the substructure, the barge including a ballastable hull forming a deck suitable for receiving the substructure in a substantially horizontal position and including ballastable floats above said deck to left and to right of the intended location for the substructure;

ballasting the hull and the floats so that although still floating the barge moves down in the water and tilts by pivoting through an angle of more than 90° to take up a position in which the deck of the barge is tilted beyond the vertical and may be applied against a face of the substructure;

fixing the barge to the substructure;

disconnecting the substructure from the sea bed;

removing ballast from the hull and the floats to cause the barge to tilt in the opposite direction and to raise it to a position in which the barge is floating with the substructure resting on the deck of the barge; and displacing the floating barge carrying the substructure to the desired location for unloading the substructure.

2. A method according to claim 1, wherein the substructure is partially disconnected from the sea bed before the barge is fixed to the substructure and wherein disconnection is completed after the barge has been fixed to the substructure.

3. A method according to claim 1, wherein the operations of ballasting and unballasting the hull and the floats of the barge are remotely controlled.

4. Apparatus for recovering the substructure of an offshore platform, the general shape of the substructure being substantially that of a truncated pyramid, the apparatus comprising a floating barge comprising a ballastable hull forming a deck suitable for receiving said substructure in a substantially horizontal position and including ballastable floats above said deck to left and to right of the intended location for the substructure, such that the barge may be lowered into the water and tilted beyond the vertical by ballasting the hull and the floats so that its deck may be applied against a face of the substructure, means being provided to fix the barge to the substructure.

5. Apparatus for recovering the substructure of an offshore platform, the general shape of the substructure being substantially that of a truncated pyramid, the apparatus comprising a floating barge comprising a ballastable hull forming a deck suitable for receiving said substructure in a substantially horizontal position and including ballastable floats above said deck to left and to right of the intended location for the substructure, such that the barge may be lowered into the water by ballasting the hull and the floats so that its deck may be applied against a face of the substructure, means being provided to fix the barge to the substructure, wherein the deck of the barge is provided with longitudinal receptions beams for receiving the substructure.

6. Apparatus according to claim 5, wherein the deck of the barge is a concrete deck including a grid of metal beams onto which the reception beams are fixed.

7. Apparatus according to claim 5, wherein in order to recover a substructure having a face which includes reinforced frame members, the reception beams are distributed in such a manner as to be applied against said frame members when the deck is applied against said face of the substructure.

8. Apparatus according to claim 5, wherein the barge is made of concrete and includes floats made of metal.

9. Apparatus according to claim 8, wherein said floats are cylindrical metal floats disposed longitudinally above said deck.

* * * * *